US006999693B2

(12) United States Patent
Ota

(10) Patent No.: US 6,999,693 B2
(45) Date of Patent: Feb. 14, 2006

(54) FIXING DEVICE AND CONTROL METHOD THEREFOR

(75) Inventor: Hiroshi Ota, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/011,203

(22) Filed: Dec. 15, 2004

(65) Prior Publication Data

US 2005/0095026 A1 May 5, 2005

Related U.S. Application Data

(63) Continuation of application No. 10/457,459, filed on Jun. 10, 2003, now Pat. No. 6,882,808.

(30) Foreign Application Priority Data

Jun. 20, 2002 (JP) ..... 2002-180221

(51) Int. Cl.
*G03G 15/20* (2006.01)

(52) U.S. Cl. ..... 399/70

(58) Field of Classification Search ..... 399/67–70, 399/320, 328
See application file for complete search history.

(56) References Cited

U.S. PATENT DOCUMENTS

| | | | |
|---|---|---|---|
| 5,448,339 | A | 9/1995 | Kokaji et al. |
| 5,724,638 | A | 3/1998 | Isogai et al. |
| 5,832,332 | A | 11/1998 | Sugiura |
| 6,185,388 | B1 | 2/2001 | Yamamoto |
| 6,567,624 | B1 | 5/2003 | Murata |

FOREIGN PATENT DOCUMENTS

| | | | |
|---|---|---|---|
| JP | 8-76620 | A | 3/1996 |
| JP | 9-258586 | A | 10/1997 |

*Primary Examiner*—Arthur T. Grimley
*Assistant Examiner*—Ryan Gleitz
(74) *Attorney, Agent, or Firm*—Foley & Lardner LLP

(57) ABSTRACT

In a standby time period in which a heating roller and a press roller are heated in a state in which a to-be-fixed medium is not fed, a fixation control section for driving and controlling a fixing device intermittently drives a motor, thereby varying a temperature of the press roller between a fixing ratio preferential mode and an energy-saving preferential mode.

10 Claims, 9 Drawing Sheets

| | ENERGY-SAVING PREFERENTIAL MODE | FIXING RATIO PREFERENTIAL MODE |
|---|---|---|
| READY-TIME LOW-SPEED PRE-RUN START TEMPERATURE | 70℃ | 100℃ |
| READY-TIME LOW-SPEED PRE-RUN END TEMPERATURE | 100℃ | 130℃ |
| HEATING ROLLER CONTROL TEMPERATURE IN PREHEATING MODE | 70℃ | 150℃ |
| PRE-RUN OPERATION AT TIME OF RESTORATION FROM PREHEATING | ABSENT | PRESENT |
| ENERGY SAVING DURING PREHEATING | PRESENT | ABSENT |

FIG. 8

| | Ea | | | | | | | | Eb | | | | | | | | CONSUMPTION EFFICIENCY (Wh/h) | | |
|---|---|---|---|---|---|---|---|---|---|---|---|---|---|---|---|---|---|---|---|
| | Ewc1(Wh) | | | | Ei1(Wh) | | | | Ewc2(Wh) | | | | Ei2(Wh) | | | | | | |
| | Ew1 | | Ec1 | | | | | | Ew2 | | Ec1 | | | | | | | | |
| | WARM-UP POWER | | COPY POWER | | READY POWER | | PREHEAT POWER | | WARM-UP POWER FOR RESTORATION | | COPY POWER | | READY POWER | | PREHEAT POWER | | COPYING MACHINE POWER | | |
| | FIX | M/C | FIX | M/C | FIX | M/C | FIX | M/C | FIX | M/C | FIX | M/C | FIX | M/C | FIX | M/C | FIX | M/C | TOTAL |
| FIXING RATIO PREFERENTIAL MODE | 84.6 | 11.7 | 87.7 | 24.1 | 88.6 | 25.2 | 76.0 | 54.0 | 10.5 | 1.7 | 84.6 | 24.0 | 53.9 | 25.1 | 86.5 | 61.1 | 248.2 | 112.3 | 360.5 |
| ENERGY-SAVING PREFERENTIAL MODE | 45.1 | 7.0 | 88.2 | 26.1 | 67.8 | 24.2 | 2.4 | 42.0 | 10.7 | 1.5 | 84.6 | 26.4 | 56.1 | 24.2 | 2.5 | 43.0 | 160.1 | 95.6 | 255.7 |

FIX : CONSUMPTION POWER INSIDE FIXING DEVICE
M/C : CONSUMPTION POWER OUTSIDE FIXING DEVICE

FIG. 9

FIXING DEVICE AND CONTROL METHOD THEREFOR

CROSS-REFERENCE TO RELATED APPLICATIONS

The present application is a continuation of U.S. application Ser. No. 10/457,459, filed Jun. 10, 2003, the entire contents of which is incorporated herein by reference.

This application is based upon and claims the benefit of priority from the prior Japanese Patent Application No. 2002-180221, filed Jun. 20, 2002, the entire contents of which are incorporated herein by reference.

BACKGROUND OF THE INVENTION

1. Field of the Invention

The present invention relates to a fixing device for fixing a toner image on a to-be-fixed medium, on which the toner image is to be fixed, and to a control method for the fixing device, in an image forming apparatus such as an electrostatic copying machine or a laser printer.

2. Description of the Related Art

Jpn. Pat. Appln. KOKAI Publication No. 8-76620, for instance, proposes a fixing device using induction heating, instead of using a halogen lamp or a heat-resistant film. In the fixing device, an electrically conductive film is heated by magnetic field generating means, and toner is fixed on a paper sheet put in close contact with the conductive film. A heat-producing belt (electrically conductive film) is clamped between a member constituting the magnetic field generating means, on the one hand, and a heating roller, on the other, thus creating a nip.

Jpn. Pat. Appln. KOKAI Publication No. 9-258586 proposes a fixing device of the type that uses a heat-producing element formed by winding a coil around a core extending along the rotational axis of a fixing roller, and causing an eddy current to flow in the fixing roller, thus heating the fixing roller.

There is known a conventional fixing device of the above-described induction-heating type, which may operate in a mode for enhancing a fixing ratio. This operation mode, however, may enhance the fixing ratio by lowering a copy speed or raising a fixing roller temperature. As a result, the productivity may deteriorate, or the life of the fixing device decreases due to temperature degradation of consumable parts. On the other hand, in recent years, from the standpoint of energy-saving, it is desired to decrease the amount of energy that is uselessly consumed when there is no need to enhance the fixing ratio.

BRIEF SUMMARY OF THE INVENTION

The object of an aspect of the present invention is to provide a fixing device and a control method, which can improve energy consumption efficiency without degrading a good fixing ratio.

In order to achieve the object, the present invention may provide a fixing device including a heating roller with a heat source, a press roller that presses the heating roller, a rotation mechanism that rotates the press roller along with the heating roller to fix a developer applied to a to-be-fixed medium fed between the heating roller and the press roller, and a fixation control section that drives the rotation mechanism and the heat source in one of a first mode and a second mode, wherein the fixation control section is configured such that in a standby time period in which the heating roller and the press roller are heated in a state in which the to-be-fixed medium is not fed, the fixation control section intermittently drives the rotation mechanism, thereby varying a temperature of the press roller between the first mode and the second mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8 is a table showing control conditions of a main control section in association with the energy-saving preferential mode and fixing ratio preferential mode;

FIG. 9 is a table showing, by numerical values, differences in energy consumption between the fixing ratio preferential mode and energy-saving preferential mode in the fixing device.

DETAILED DESCRIPTION OF THE INVENTION

An embodiment of the present invention will now be described with reference to the accompanying drawings.

Figure 1:
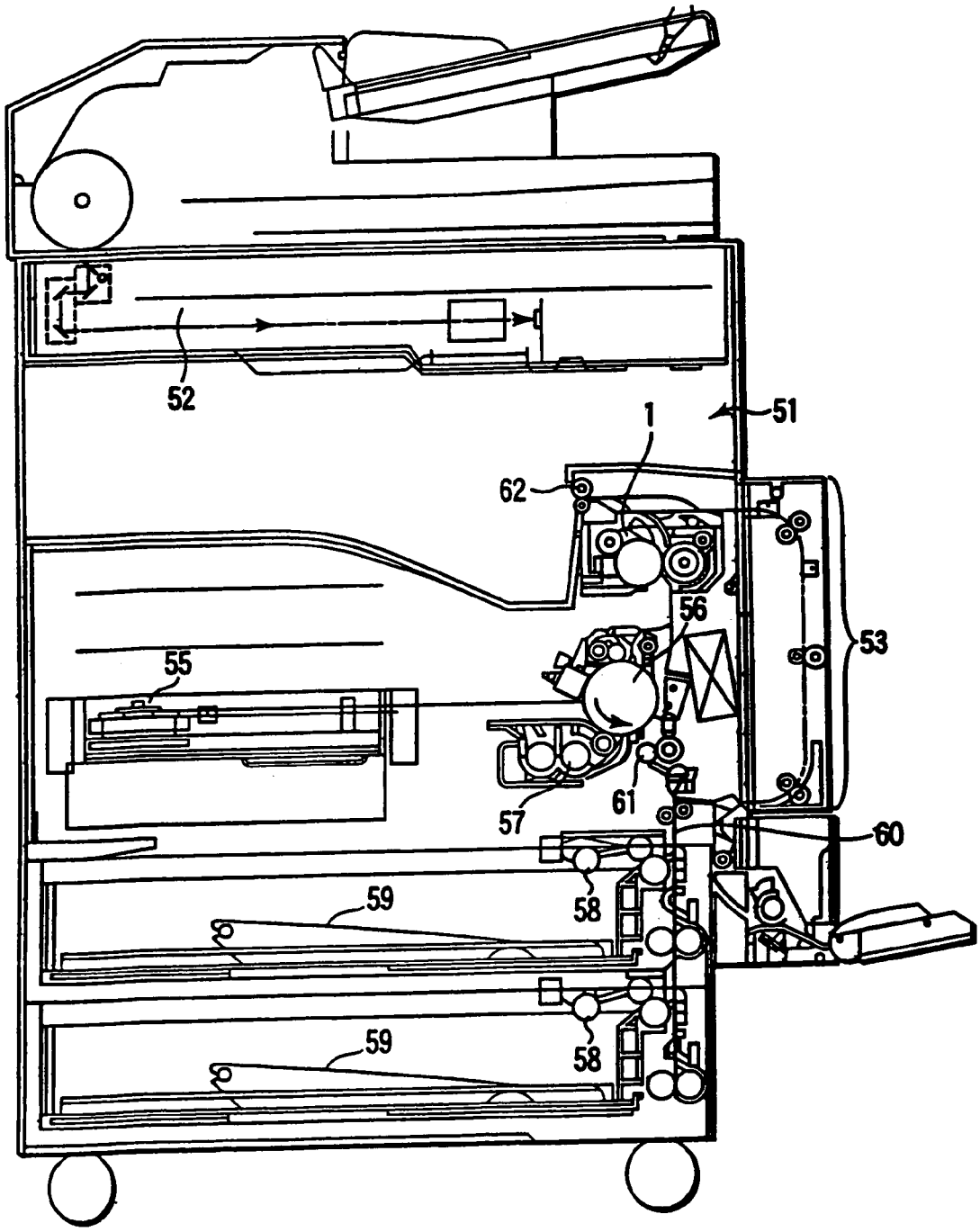
FIG. 1 schematically shows the structure of a digital copying machine according to an embodiment of the present invention.

FIG. 1 schematically shows the structure of a digital copying machine 51 including a fixing device of the present invention. The digital copying machine 51 comprises a scanner 52 that reads image information on an object to be copied, as optical light/dark information, thus producing an image signal, and an image forming section 53 that forms an image corresponding to an image signal supplied from the scanner 52 or from the outside.

The image forming section 53 includes an exposure device 55, a photosensitive drum 56, a developing device 57 and a fixing device 1.

The exposure device 55 radiates a laser beam corresponding to the image signal supplied from the scanner 52 or from an external device.

The photosensitive drum 56 carries an image corresponding to the laser beam from the exposure device 55.

The developing device 57 supplies a developer to the image formed on the photosensitive drum 56, thus developing the image.

The fixing device 1 heats and fuses a developer image and fixes it on a paper sheet (a to-be-fixed medium). In this case, the developer image, which has been developed by the developing device 57, is transferred from the photosensitive drum 56 onto the paper sheet that is fed by a sheet convey section (to be described later).

When the image signal has been supplied from the scanner 52 or an external device to the exposing device 55, the exposing device 55 radiates a laser beam, which is intensity-modulated on the basis of the image signal, to the photosensitive drum 56 that is pre-charged with a predetermined potential. Thereby, an electrostatic latent image corresponding to the image to be copied is formed on the photosensitive drum 56.

The electrostatic latent image formed on the photosensitive drum 56 is selectively supplied with toner T by the developing device 57 and is developed into a toner image (developer image). Then, the toner image on the photosensitive drum 56 is transferred by a transfer device onto a paper sheet P (to-be-fixed medium) fed from a sheet cassette (to be described later). After the transfer, the sheet P is conveyed to the fixing device 1. The fixing device 1 fuses the toner T on the conveyed sheet P and fixes it on the sheet P.

The paper sheet P is taken out, one by one, from a sheet cassette 59 disposed below the photosensitive drum 56 by means of a pickup roller 58. The sheet P is then conveyed to an aligning roller 61 along a convey path 60 extending toward the photosensitive drum 56. The aligning roller 61 is used to align the sheet P with the toner image formed on the photosensitive drum 56. The sheet P is conveyed, at a predetermined timing, to a transfer position where the photosensitive drum 56 faces the transfer device (not shown).

On the other hand, the sheet P, on which the toner T is fixed by the fixing device 1, is conveyed to an output roller 62. The output roller 62 outputs the sheet P to an output space (output tray) defined between the scanner 52 and the cassette 59.

The fixing device 1 will now be described in detail.

Figure 2:
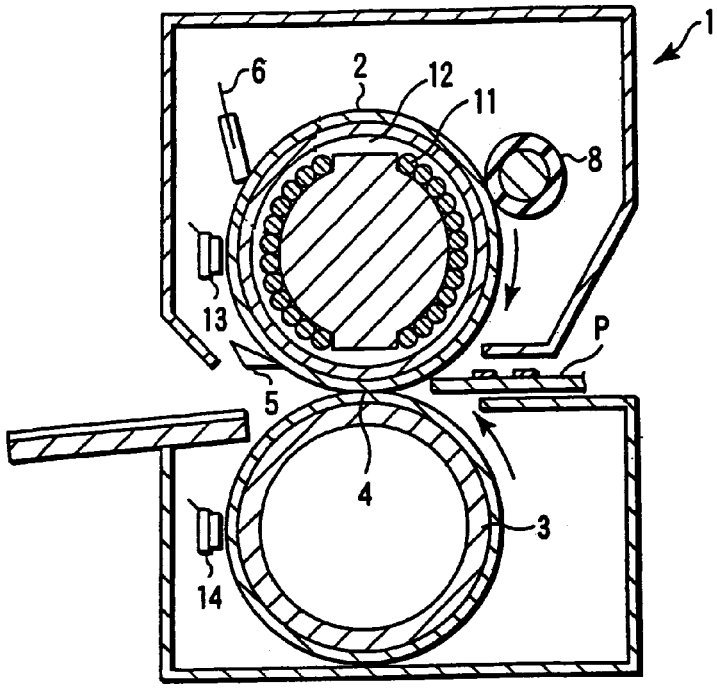
FIG. 2 is a cross-sectional view showing a cross-sectional structure of a fixing device, taken along a line perpendicular to the longitudinal direction of the fixing device.
Figure 3:
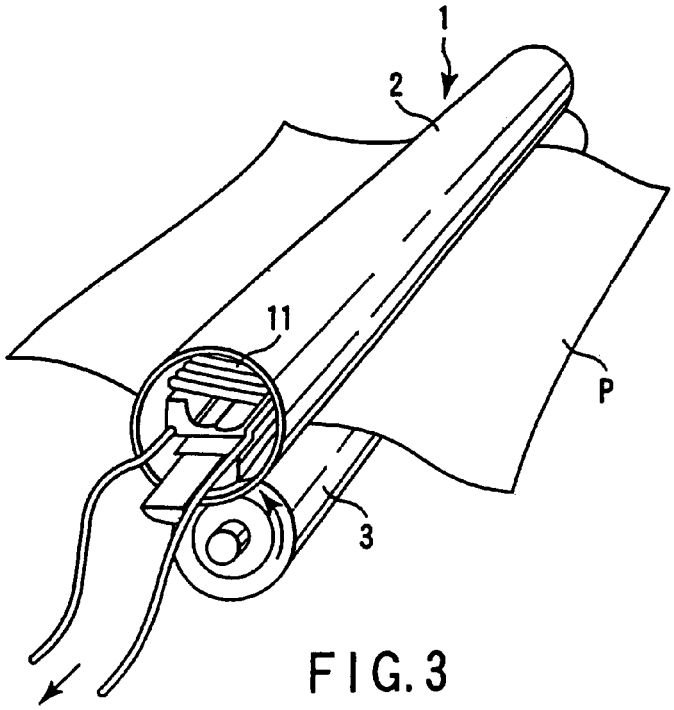
FIG. 3 is a perspective view schematically showing an external appearance of a roller structure and a magnetic field generating mechanism of the fixing device.
Figure 4:
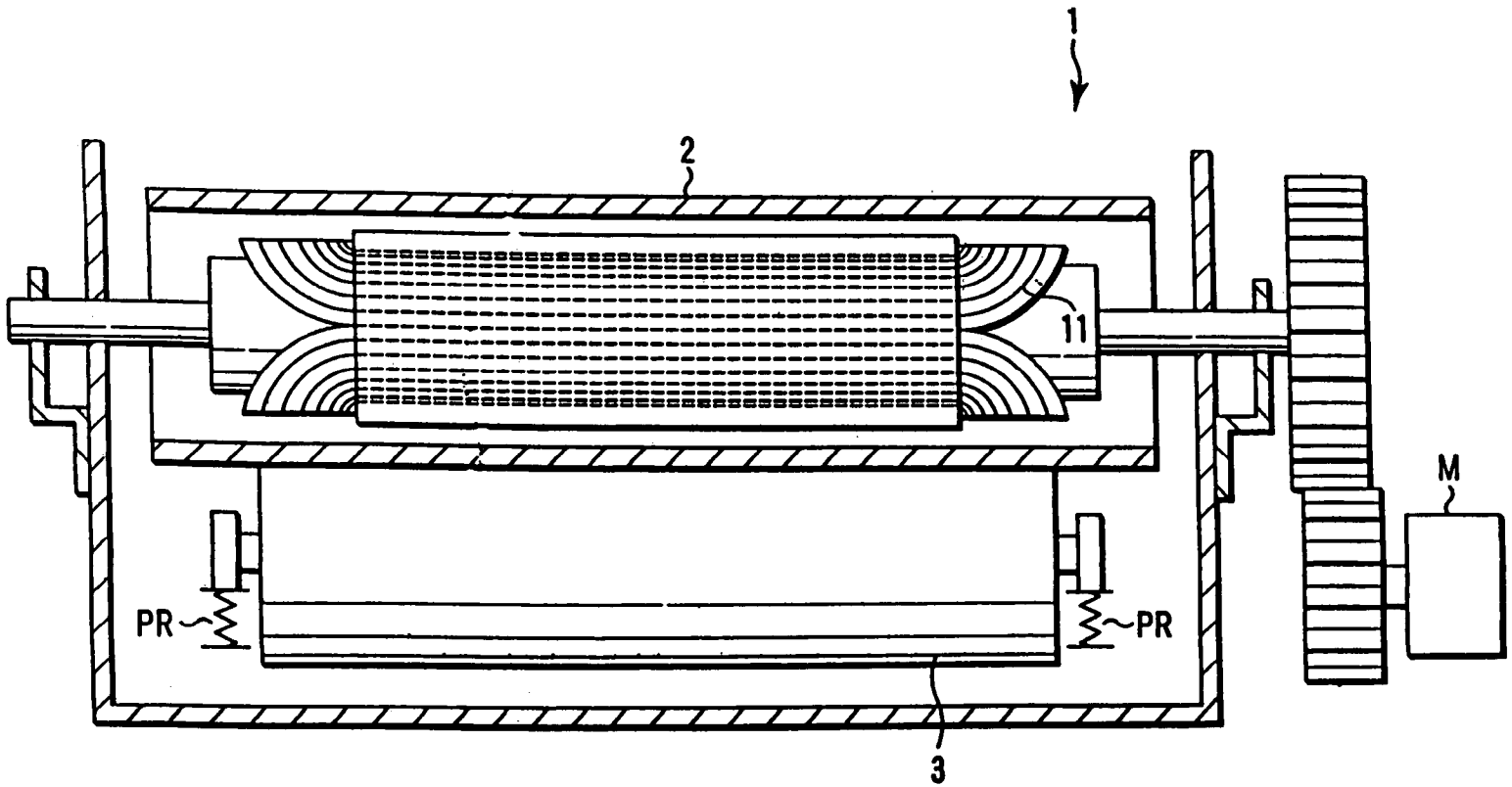
FIG. 4 is a cross-sectional view showing a cross-sectional structure of the fixing device, taken along the longitudinal axis of the fixing device.

FIG. 2 shows a cross-sectional structure of the fixing device 1, taken along a line perpendicular to the longitudinal direction of the fixing device 1. FIG. 3 schematically shows an external appearance of a roller structure and a magnetic field generating mechanism of the fixing device 1. FIG. 4 shows a cross-sectional structure of the fixing device 1, taken along the longitudinal axis of the fixing device 1.

As is shown in FIGS. 2 to 4, the fixing device 1 includes a heating (fixing) roller and a press roller 3. The heating roller 2 has an outside diameter of, e.g. 60 mm, and the press roller 3 has an outside diameter of, e.g. 50 mm. The heating roller 2 rotates in a direction of an arrow (in FIG. 2), and the press roller 3 follows the rotation of the heating roller 2 and rotates in a direction of an arrow (in FIG. 2). A toner image is formed on a paper sheet P, and the paper sheet P passes between both rollers as a to-be-fixed medium.

The heating roller 2 is formed such that fluororesin, etc. is coated on a surface of an iron cylindrical member having a thickness of, e.g. 1 mm, which is provided as an endless member having a conductive metal layer. Alternatively, the heating roller 2 may be formed of stainless steel, an alloy of stainless steel and aluminum, etc.

The press roller 3 is constructed such that a core metal is covered with an elastic material, such as foamed silicone rubber, having a thickness of about 6 mm, and the resultant structure is further covered with a fluororesin tube. The press roller 3 is put in pressure contact with the heating roller 2 by a pressing mechanism PR with a predetermined pressure of, e.g. 300 N to 600 N. Thereby, a nip 4 with a predetermined width is created by resilient deformation of the outer peripheral surface of the press roller 3 in a region of pressure contact between both rollers 2 and 3. In this embodiment, the nip 4 has a predetermined width of about 7 mm to 10 mm. The toner on the paper sheet P is fused while the sheet P is passing through the nip 4, and the fused toner is fixed on the sheet P.

A separation gripper 5, a cleaning member 6 and a release-agent applying device 8 are disposed around the outer periphery of the heating roller 2 on the downstream side of the nip 4 in the rotational direction of the heating roller 2.

The separation gripper 5 separates the paper sheet P from the heating roller 3.

The cleaning member 6 removes from the outer peripheral surface of the heating roller 2 the toner, which is offset-transferred on the outer peripheral surface of the heating roller 2, or paper dust of the sheet P.

The release-agent applying device 8 applies a release agent to the outer peripheral surface of the heating roller 2, thereby preventing toner from adhering thereto.

An excitation coil 11 is provided within the heating roller 2. The excitation coil 11 serves as magnetic field generating means comprising litz wire that is composed of a plurality of mutually insulated copper wire elements each having a diameter of, e.g. 0.5 mm. By forming the excitation coil of litz wire, the wire diameter can be made less than the depth of permeation, thus making it possible to cause an alternating current to flow efficiently.

In this embodiment, the excitation coil 11 comprises 16 wire elements each having a diameter of 0.5 mm and being coated with heat-resistant polyamide-imide.

The excitation coil 11 is a coreless coil without a core member (e.g. a ferrite or ion core). Since the excitation coil 11 is a coreless coil, a core material with complex structure is needless and the manufacturing cost is reduced. In addition, the excitation circuit is fabricated at low cost. The excitation coil 11 is supported by a coil support member formed of a heat-resistant resin (e.g. high-heat-resistance plastic for industrial use). The coil support member 12 is positioned between structural members (metal plates) that support the heating roller 2.

The excitation coil 11 is driven by a radio-frequency current to produce a magnetic flux. Thereby, the excitation coil 11 causes a magnetic flux and eddy current in the heating roller 2 so as to prevent a variation in magnetic field. The eddy current and the inherent resistance of the heating roller 2 produce Joule heat, and the heating roller 2 is heated. In this embodiment, a radio-frequency current with 25 kHz and 900 W is caused to flow in the excitation coil 11.

Figure 5:
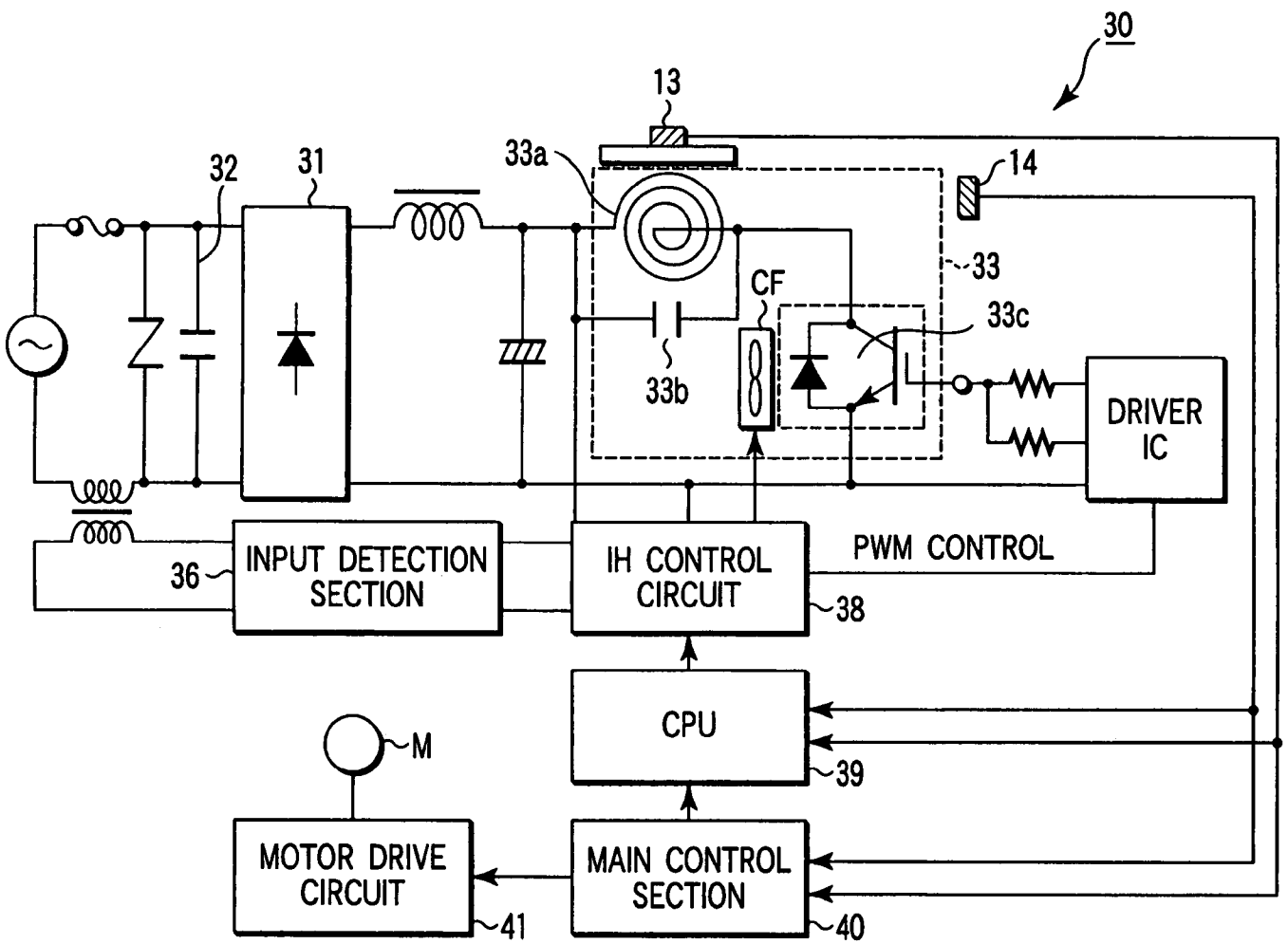
FIG. 5 is a circuit diagram showing the structure of a fixation control section of the fixing device.

FIG. 5 shows the structure of a fixation control section 30 of the fixing device 1. In the fixation control section 30, a radio-frequency current to be supplied to the excitation coil 11 is obtained by first rectifying a commercial AC supply power through a rectifier circuit 31 and a smoothing capacitor 32. The smoothed current is supplied to an inverter circuit 33 comprising a coil 33*a*, a resonance capacitor 33*b* and a switching circuit 33*c*. The switching circuit 33*c* includes a switching element, such as an insulated gate bipolar transistor (IGBT), and a heat sink to which the switching element is attached. The switching circuit 33*c* is cooled by a fan CF driven in synchronism with, e.g. the start of power supply to the excitation coil. The fan CF is controlled by, e.g. an IH (Induction Heating) control circuit 38 such that the fan CF may rotate, at least, during the time period in which the radio-frequency current is supplied to the excitation coil 11. With this structure, the fan CF can feed air only at the time of minimum necessity, and the heat sink can efficiently be cooled without undesirably increasing power consumption.

The radio-frequency current is detected by an input detection section 36 and controlled to provide a designated output value. The designated output value can be controlled by altering a power-on time of the switching circuit 33*c* at a desired timing by, e.g. PWM (pulse width modulation) control. At this time, the driving frequency varies.

The temperature of the heating roller 2 is detected by a temperature sensor 13, and the temperature of the press roller 3 is detected by a temperature sensor 14. These sensors 13 and 14 are disposed at positions corresponding substantially to middle portions of the heating roller 2 and press roller 3 in their longitudinal directions. In this embodiment, thermocouples are used as temperature sensors 13 and 14. Alternatively, thermistors may be used. Temperature information from the temperature sensors 13 and 14 is input to a CPU 39 and a main control section 40 of the copying machine 51.

The control section 40 has an energy-saving preferential mode and a fixing ratio preferential mode. The control section 40 controls the CPU 39 in accordance with these modes. The CPU 39 produces ON/OFF signals on the basis of the temperature information from the temperature sensors 13 and 14, thereby controlling the IH (Induction Control) control circuit 38. The main control section 40 controls a motor drive circuit 41 in accordance with these modes, thereby driving a motor M that rotates the heating roller 2.

Figure 6:
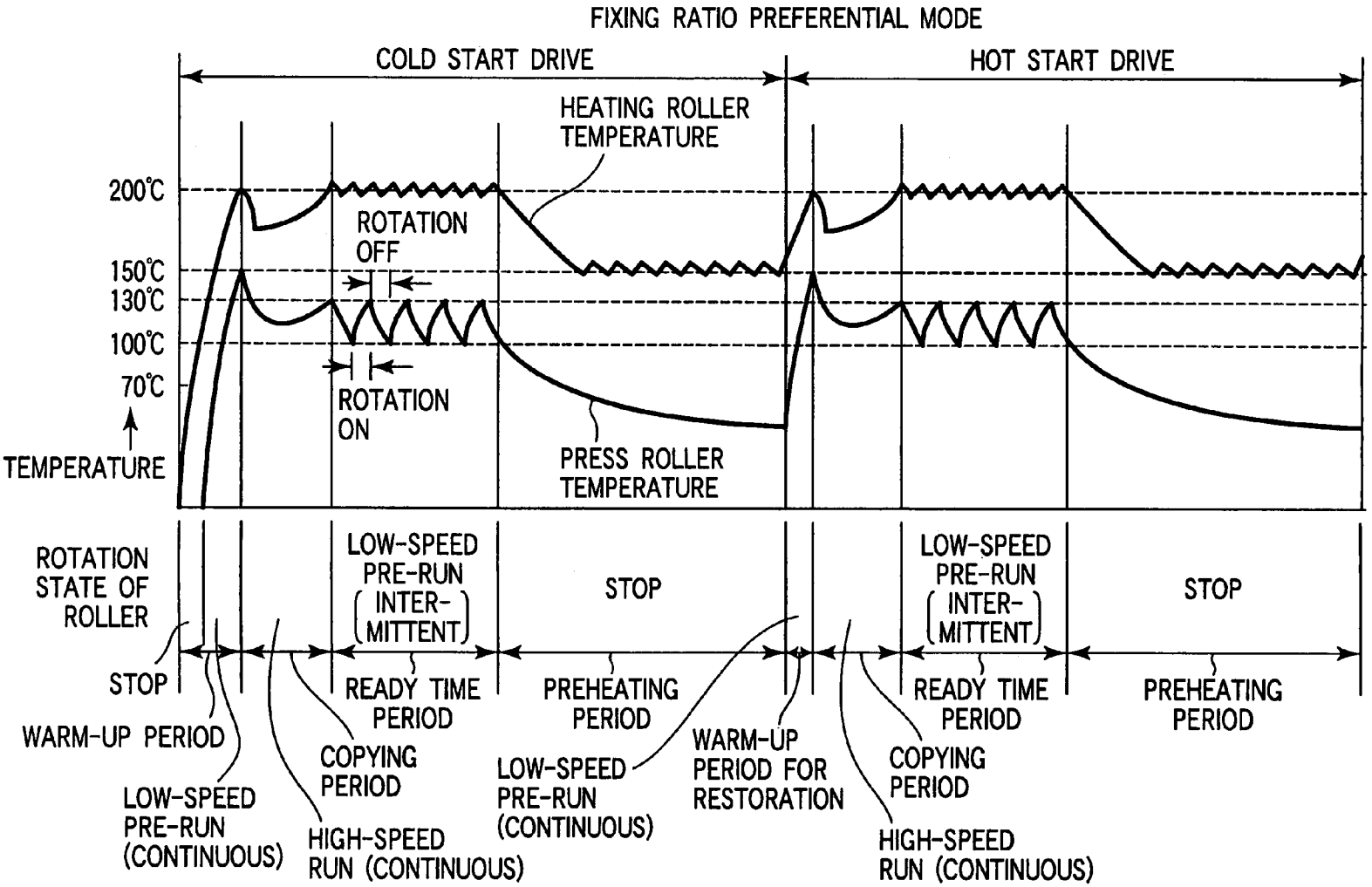
FIG. 6 illustrates the relationship between temperature and time of a heating roller and a press roller in a fixing ratio preferential mode.

FIG. 6 illustrates the relationship between temperature and time of the heating roller 2 and press roller 3 in the fixing ratio preferential mode.

Figure 7:
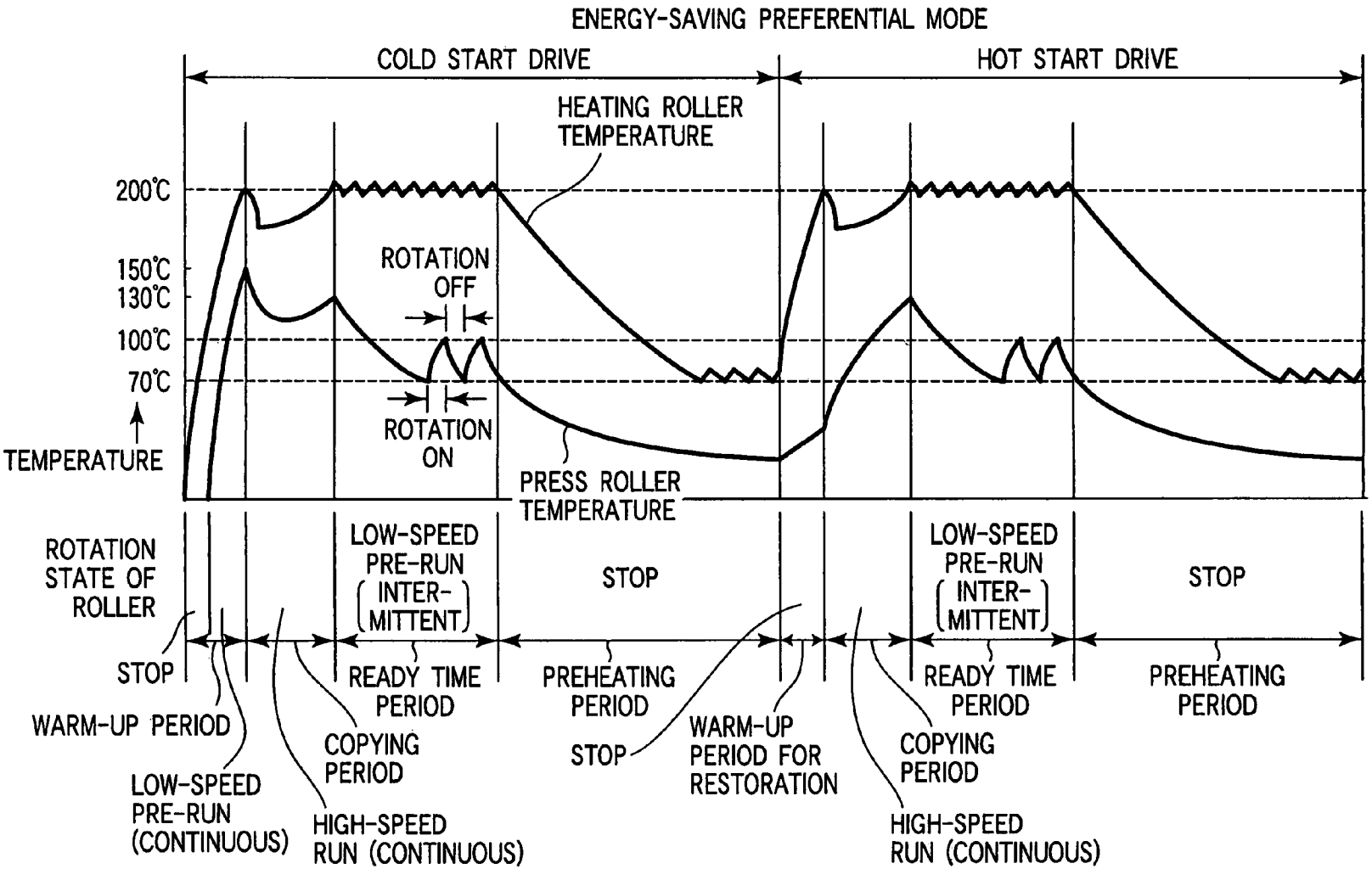
FIG. 7 illustrates the relationship between temperature and time of the heating roller and press roller in an energy-saving preferential mode.

FIG. 7 illustrates the relationship between temperature and time of the heating roller 2 and press roller 3 in the energy-saving preferential mode.

For example, when a commercial power supply of 1500 W is considered, it is possible in the initial operation stage to supply the excitation coil 1 with all power, except the power to be consumed by the components of the main body of the copying machine excluding the fixing device 1.

In the case of the embodiment of this invention, a power of 1300 W is supplied to the excitation coil 11 immediately after the start of the warming-up time. The motor M starts rotating the heating roller 2 and press roller 3 when the temperature of the heating roller 2 exceeds a designated temperature. Thus, from this time point, a power of 1100 W is supplied to the excitation coil 11 as a value of power that is obtained by subtracting power consumed by the rotation of the motor M and power consumed in other processes.

In the induction heating method, the output is adjustable by varying the frequency. Thus, the heating roller 2 can efficiently be heated by varying the supply power according to a plurality of control patterns.

In order to vary the supply power, the IH control circuit 38 alters the turn-on time of the switching circuit 33*c* on the basis of an IH control signal from the CPU 39, thus controlling the value of output supplied to the excitation coil 11. At this time, the turn-on time of the switching circuit 33*c* increases as the output increases. Consequently, the frequency of the output current decreases.

As stated above, the radio-frequency output to the fixing device 1 at the time of feeding paper (i.e. at the time of image formation) can be decreased, and the power consumption at the time of feeding paper can be reduced.

FIG. 8 shows control conditions of the main control section 40 corresponding to the energy-saving preferential mode and fixing ratio preferential mode. In a ready (standby) time period and a preheating time period following the copying time, the main control section 40 is designed to perform different controls in accordance with the energy-saving preferential mode and fixing ratio preferential mode.

The control conditions for the energy-saving preferential mode are as follows. The ready-time low-speed pre-run start temperature of the press roller 3 is 70° C., the ready-time low-speed pre-run end temperature of the press roller 3 is 100° C., a pre-run operation at the time of restoration from preheating is absent, and energy-saving during preheating, such as the stop of the fan, is present.

On the other hand, the control conditions for the fixing ratio preferential mode are as follows. The ready-time low-speed pre-run start temperature of the press roller 3 is 100° C., the ready-time low-speed pre-run end temperature of the press roller 3 is 130° C., a pre-run operation at the time of restoration from preheating is present, and energy-saving during preheating, such as the stop of the fan, is absent.

Addition of such control conditions is optional.

If the copying time period ends, the main control section 40 performs a ready-time control. In the ready-time control, the main control section 40 controls the CPU 39, thus continuing the driving of the excitation coil 11 by the IH control circuit 38. The main control section 40 also controls the motor drive circuit 41, thus stopping the rotation of the heating roller 2 by the motor M. Thereafter, the main control section 40 monitors the temperature information from the temperature sensor 13, and maintains the temperature of the heating roller 2 in the vicinity of 200° C.

In addition, the main control section 40 monitors the temperature information from the temperature sensor 14. When the main control section 40 detects that the temperature of the press roller 3 has become lower than the ready-time low-speed pre-run start temperature, the main control section 40 resumes the rotation of the heating roller 2. Specifically, the resumption is effected when the temperature of the press roller 3 has become lower than 100° C. in the fixing ratio preferential mode shown in FIG. 6, and when the temperature of the press roller 3 has become lower than 70° C. in the energy-saving preferential mode shown in FIG. 7.

Furthermore, the main control section 40 monitors the temperature information from the temperature sensor 14. When the main control section 40 detects that the temperature of the press roller 3 has become higher than the ready-time low-speed pre-run end temperature, the main control section 40 stops the rotation of the heating roller 2. Specifically, the rotation is stopped when the temperature of the press roller 3 has become higher than 130° C. in the fixing ratio preferential mode shown in FIG. 6, and when the temperature of the press roller 3 has become higher than 100° C. in the energy-saving preferential mode shown in FIG. 7. These controls are repeated, and the press roller 3 is intermittently rotated along with the heating roller 2. Thereby, a decrease in temperature of the heating roller 3 is prevented.

For example, if there is no instruction for resumption of the copying operation even after passing of about 15 minutes, the main control section 40 performs a control of the preheating time period. In this control, the main control section 40 controls the CPU 39, thus causing the IH control circuit 38 to lower the drive power to the excitation coil 11. In addition, the main control section 40 controls the motor drive circuit 41, thus casing the motor M to stop rotating the heating roller 2. The temperature of the heating roller 2 is controlled and set at 150° C. in the fixing ratio preferential mode shown in FIG. 6, and at 70° C. in the energy-saving preferential mode shown in FIG. 7.

In the digital copying machine 51 of this embodiment, in order to shorten the start-up time until the fixing device 1 can perform the copying operation, the IH (Induction Heating) method that permits efficient, fine output control is used for the heating roller 2. In addition, the press roller 3 is formed of foamed rubber that has a low heat capacity, achieves quick temperature rise, and provides a large nip width under low pressure. With the combination of the heating roller 2 and press roller 3, the time for the start-up of the fixing device 1 is decreased, and smooth switching can be effected between the energy-saving preferential mode and fixing ratio preferential mode.

Moreover, according to the combination of the heating roller 2 and press roller 3, in the energy-saving preferential mode, the temperature of the press roller 3 in the standby state is controlled and lowered to a critical point where a normal copying operation is executable with no problem. Thereby, the power consumption is lowered to a minimum. On the other hand, in the fixing ratio preferential mode, the temperature of the press roller 3 is controlled and maintained at a sufficiently high level, thus enabling fixation even on a paper sheet that does not permit easy fixation, such as a thick paper sheet.

The switching between the energy-saving preferential mode and fixing ratio preferential mode can substantially be effected only by altering the temperature control of the press roller 3 that is in the standby state. That is, there is no need to raise the temperature of the heating roller 2 in the fixing ratio preferential mode to a level higher than a normal value, and so thermal degradation of the fixing device 1 itself or its peripheral components due to high temperatures can be prevented.

Since smooth switching is effected between the energy-saving preferential mode and fixing ratio preferential mode, only a necessary amount of energy may be used only when necessary. Thus, the energy consumption can be minimized, while maintaining the efficiency in use without deteriorating the productivity with respect to the copying speed and fixing temperatures.

Besides, since the start-up of the fixing device 1 is quick, the energy consumption during warming-up can be suppressed and the temperature in the preheating standby mode can be set at a remarkably low level.

Assume that the copying machine 51 has a copying performance of 50 to 80 sheets per minute and the fixing device 1 is operated under control conditions shown in FIG. 8. In this case, energy consumption differs, as a result, between the fixing ratio preferential mode and energy-saving preferential mode, as shown in FIG. 9.

Figure 10:
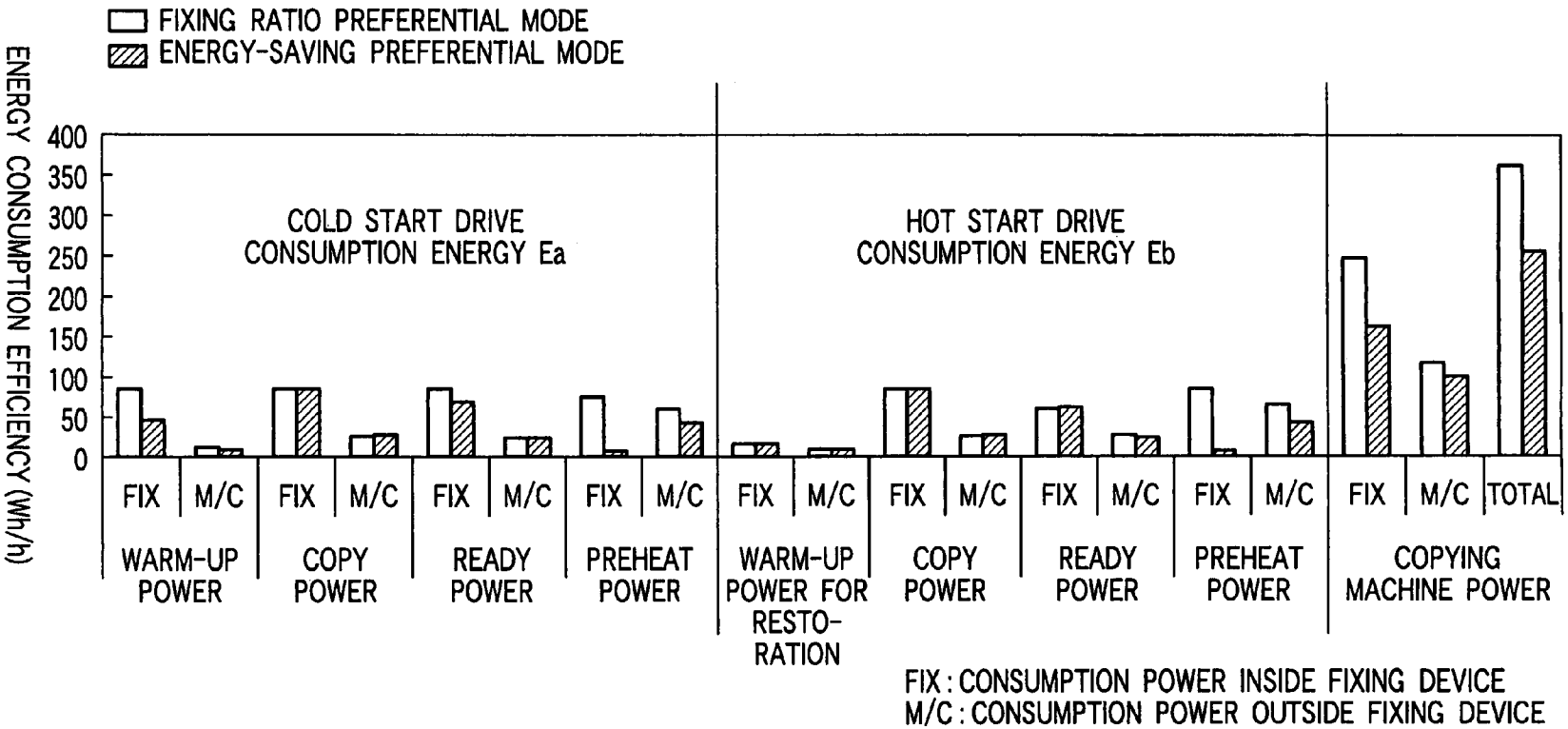
FIG. 10 is a comparative view that visually illustrates differences in energy consumption between the fixing ratio preferential mode and energy-saving preferential mode.

FIG. 10 is a graph that visually illustrates differences in energy consumption between the fixing ratio preferential mode and energy-saving preferential mode. That is, FIG. 10 shows a measurement result obtained by a method of measuring "energy consumption efficiency", indicating how much the energy consumption can be reduced in the energy-saving preferential mode, relative to the fixing ratio preferential mode. Specifically, the energy consumption is 360.5 Wh/h in the fixing ratio preferential mode, and it decreases to 255.7 Wh/h in the energy-saving preferential mode.

The present invention is not limited to the above-described embodiment, and various modifications can be made without departing from the spirit of the invention.

In the above-described embodiment, the ready-time pre-run start temperature and ready-time pre-run end temperature are set for each of the fixing ratio preferential mode and energy-saving preferential mode. This means that different temperature ranges of the press roller 3 are set between the fixing ratio preferential mode and energy-saving preferential mode. Alternatively, the main control section 40 may be configured as follows. Different specific temperatures are set as reference temperatures of the press roller 3 between the fixing ratio preferential mode and energy-saving preferential mode, and these reference temperatures are compared with the temperature information from the temperature sensor 14. Based on comparison results, the motor M is turned on/off and the temperature of the press roller 3 may be controlled and set at a value corresponding to each mode.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device including a heating roller with a heat source, a press roller that presses the heating roller, a rotation mechanism that rotates the press roller along with the heating roller to fix a developer applied to a to-be-fixed medium fed between the heating roller and the press roller, and a fixation control section that drives the rotation mechanism and the heat source in one of a first mode and a second mode, wherein in a standby time period in which the heating roller and the press roller are heated in a state in which the to-be-fixed medium is not fed, the fixation control section detects the temperature of the press roller and compares the detected temperature with a first reference temperature and a second reference temperature assigned to the first mode and a first reference temperature and a second reference temperature assigned to the second mode, thereby controlling turn-on/off of the rotation mechanism, and the first reference temperature assigned to the first mode is set higher than the first reference temperature assigned to the second mode and the second reference temperature assigned to the first mode is set higher than the second reference temperature assigned to the second mode.

2. The fixing device according to claim 1, wherein each of the heating roller and the press roller has at least one of an induction heating type heat source and a foamed elastic material surface.

3. The fixing device according to claim 1, wherein the fixation control section controls the rotation mechanism such that a rotation speed of the press roller in the standby time period is set lower than at a time of image forming operation.

4. The fixing device according to claim 1, wherein an excitation coil is used for the heat source of the heating roller.

5. A control method for a fixing device including a heating roller with a heat source, a press roller that presses the heating roller, a rotation mechanism that rotates the press roller along with the heating roller to fix a developer applied to a to-be-fixed medium fed between the heating roller and the press roller, and a fixation control section that drives the rotation mechanism and the heat source in one of a first mode and a second mode, the method comprising:

detecting a temperature of the press roller in a standby time period in which the heating roller and the press roller are heated in a state in which the to-be-fixed medium is not fed;

comparing the detected temperature with a first reference temperature and a second reference temperature assigned to the first mode and a first reference temperature and a second reference temperature assigned to the second mode, thereby controlling turn-on/off of the rotation mechanism, in the standby time period;

setting the first reference temperature assigned to the first mode higher than the first reference temperature assigned to the second mode in the standby time period; and setting the second reference temperature assigned to the first mode higher than the second reference temperature assigned to the second mode in the standby time period.

6. The control method according to claim 5, further comprising setting a rotation speed of the press roller in the standby time period lower than at a time of image forming operation.

7. The control method according to claim 5, wherein an excitation coil is used for the heat source of the heating roller.

8. A fixing device including heating means with a heat source, pressing means for pressing the heating means, rotating means for rotating the pressing means along with the heating means to fix a developer applied to a to-be-fixed medium fed between the heating means and the pressing means, and fixation controlling means for controlling the rotating means and the heat source in one of a first mode and a second mode, wherein in a standby time period in which the heating means and the pressing means are heated in a state in which the to-be-fixed medium is not fed, the fixation controlling means detects a temperature of the pressing means and compares the detected temperature with a first reference temperature and a second reference temperature assigned to the first mode and a first reference temperature and a second reference temperature assigned to the second mode, thereby controlling turn-on/off of the rotating means, and the first reference temperature assigned to the first mode is set higher than the first reference temperature assigned to the second mode and the second reference temperature assigned to the first mode is set higher than the second reference temperature assigned to the second mode.

9. The fixing device according to claim 8, wherein the fixation controlling means controls the rotating means such that a rotation speed of the pressing means in the standby time period is set lower than at a time of image forming operation.

10. The fixing device according to claim 8, wherein an excitation coil is used for the heat source of the heating means.

* * * * *